US005802424A

United States Patent [19]

Pernesky et al.

[11] Patent Number: 5,802,424

[45] Date of Patent: Sep. 1, 1998

[54] CONTROL FOR ENVIRONMENT OF A CHARGER FOR REPRODUCTION APPARATUS

[75] Inventors: Martin J. Pernesky, Hornell; John W. May, Rochester, both of N.Y.

[73] Assignee: Eastman Kodak Company, Rochester, N.Y.

[21] Appl. No.: 979,503

[22] Filed: Nov. 26, 1997

[51] Int. Cl.[6] ..... G03G 15/00; G03G 15/02; G03G 21/00

[52] U.S. Cl. ..... 399/92

[58] Field of Search ..... 399/91, 92, 98, 399/99, 100, 101; 15/1.51, 300.1, 319

[56] References Cited

U.S. PATENT DOCUMENTS 4,169,673 10/1979 Sato et al. ..... 399/92 X

FOREIGN PATENT DOCUMENTS 1-304473 12/1989 Japan .

*Primary Examiner*—Arthur T. Grimley
*Assistant Examiner*—Sophia S. Chen
*Attorney, Agent, or Firm*—Lawrence P. Kessler

[57] ABSTRACT

An environmental control for a charger utilized in an electrostatographic reproduction apparatus including a movable dielectric support upon which images of information to be reproduced are formed as the dielectric support is moved into operative relation with electrostatic process stations. The charger environmental control system as disclosed includes a housing associated with charger. The housing is selectively provided with a positive pressure air flow or a negative pressure air flow. The positive pressure air flow and the negative pressure air flow are controlled such that during movement of the dielectric support of the reproduction apparatus, positive pressure air flow is provided to the housing, and when such dielectric support is at rest, negative pressure air flow is provided to the housing.

11 Claims, 3 Drawing Sheets

CONTROL FOR ENVIRONMENT OF A CHARGER FOR REPRODUCTION APPARATUS

CROSS-REFERENCE TO RELATED APPLICATION

This application is related to U.S. Patent application Ser. No. 08/885,309, filed Jun. 30, 1997, in the names of Hoffman et al.

BACKGROUND OF THE INVENTION

The present invention relates in general to control of the environment of a reproduction apparatus, and more particularly to environmental control for a charger of a reproduction apparatus.

In typical commercial electrostatographic reproduction apparatus (copier/duplicators, printers, or the like), a latent image charge pattern is formed on a uniformly charged charge-retentive or photo-conductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

Reproduction apparatus, of the above described type, and their environment have a significant interrelation. The production of electrical fields within the reproduction apparatus, such as for charging and transfer, generate appreciable ozone. It is necessary to control the ozone within the reproduction apparatus to ensure that the apparatus operates at maximum efficiency. Further, ozone can markedly degrade the desired output of the reproduction apparatus. Moreover, it is necessary to control the ozone which can escape into the ambient environment surrounding the reproduction apparatus to assure user safety.

It has also been found that, in addition to ozone, chargers produce undesirable oxides of nitrogen. In typical electrostatographic reproduction apparatus, catalytic surfaces are provided to destroy much of the ozone generated by the chargers. Additionally, as described in the above mentioned U.S. Patent application Ser. No. 08/885,309, ozone is carried away from the vicinity of the chargers by an air flow which is vented into the environment through filters. The oxides of nitrogen, while in lower concentration than that of ozone, nevertheless may degrade image quality. Such oxides of nitrogen can form conductive chemical species, such as nitric acid, on the dielectric support. As a result, the normally insulative surface of the dielectric support, in the dark, can become conductive enough by absorption of charger byproducts so as to cause the latent electrostatic images to blur, thereby degrading the resolution of the images upon development. This problem of conductive species build up is especially serious when the dielectric member is parked under a charger for an extended period of time, such as during stand-by or the cycle down mode.

While local control of both ozone and oxides of nitrogen can be effected by employing negative air pressure in the charger area, the negative pressure may draw particulates and fibers from other parts of the reproduction apparatus into the charger. This is generally undesirable in that the particulates and fibers can deposit on the charger grid thereby reducing charging uniformity. The particulates and fibers may also deposit on the corona wire or walls of the charger giving rise to unwanted nonuniform charging currents, or to arcing.

SUMMARY OF THE INVENTION

In view of the foregoing discussion, this invention is directed to an environmental control for a charger utilized in an electrostatographic reproduction apparatus including a movable dielectric support upon which images of information to be reproduced are formed as the dielectric support is moved into operative relation with electrostatic process stations. The charger environmental control, which removes undesirable ozone and oxides of nitrogen, as disclosed, includes a housing associated with charger. The housing is selectively provided with a positive pressure air flow or a negative pressure air flow. The positive pressure air flow and the negative pressure air flow are controlled such that during movement of the dielectric support of the reproduction apparatus, positive pressure air flow is provided to the housing, and when such dielectric support is at rest, negative pressure air flow is provided to the housing.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
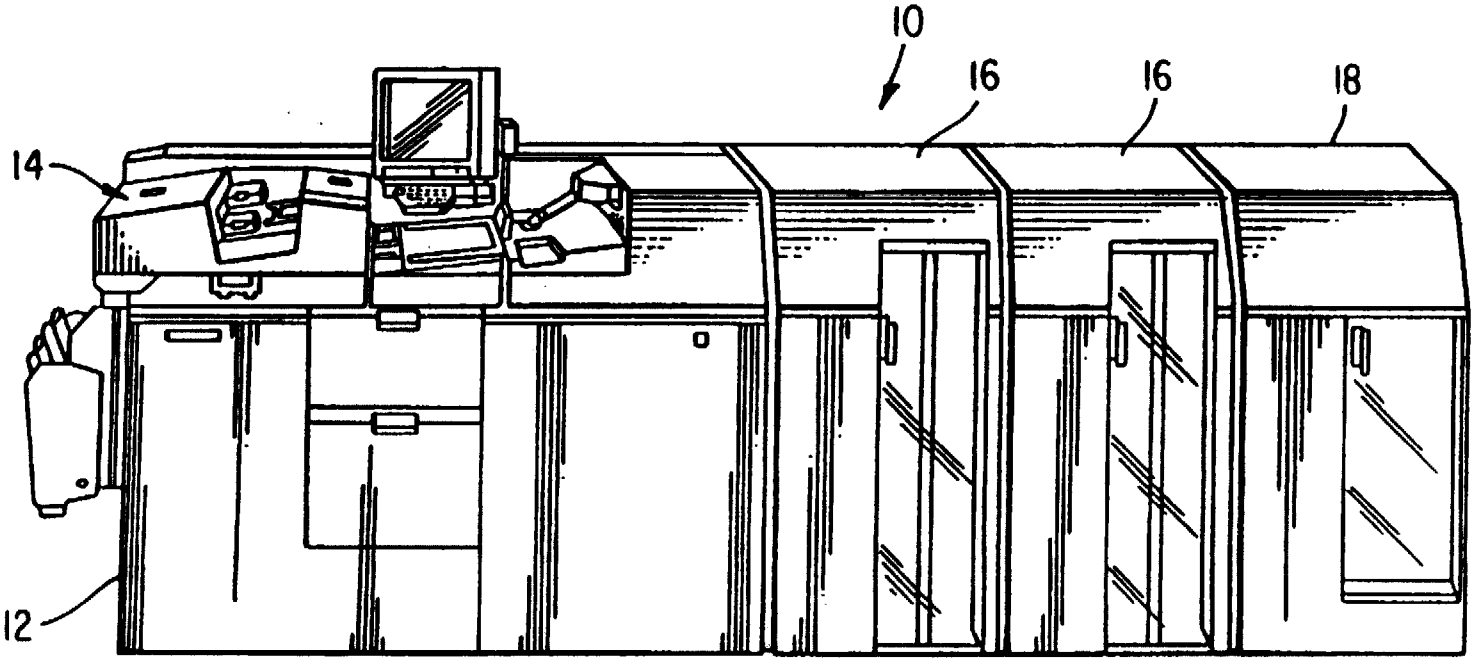
FIG. 1 is a front elevational view, in perspective, of an exemplary reproduction apparatus adapted to include the charger environmental control according to this invention.

Referring now to the accompanying drawings, an exemplary reproduction apparatus, designated generally by the numeral 10, is shown in FIG. 1. The reproduction apparatus 10 includes a reprographic marking engine 12 for reproducing information supplied thereto, such as by an original document sheet feeder 14, and a variety of accessories for facilitating the handling of reproduction output from the marking engine. In the apparatus 10 shown here, the accessories include a plurality of sorter towers 16, and a stacker/stapler 18. The sorter towers, and stacker/stapler are of any particular construction well known in the art of reproduction apparatus. The reprographic marking engine 12 of the depicted reproduction apparatus 10 is, for example, an electrostatographic copier or printer, or a combination of the two. Generally speaking, a copier reproduces information from original documents by optical exposure of such documents, while a printer reproduces information from electronic signals representative of such information. Of course, other arrangements for reproduction apparatus, utilizing a different type of reprographic marking engine, or a different number or arrangement of accessories, are suitable for use with this invention.

As noted above, electrographic reproduction apparatus and the environment for such apparatus are significantly interrelated. Heat, noise, and ozone produced by operation of the reproduction apparatus must be optimally accounted for and controlled to assure that the reproduction apparatus functions at peak efficiency without adversely effecting the surrounding environment and subjecting users to various associated health risks. An environmental management strategy which integrates control of those component factors (i.e., heat, airflow, noise, and ozone) having an impact on both the interior and exterior environment of the reproduction apparatus is fully described in aforementioned U.S. Patent application Ser. No. 08/885,309, filed Jun. 30, 1997. As such, the deleterious impact on the surrounding environment for the reproduction apparatus will be minimized, and the operating environment within the reproduction apparatus will be enhanced. The integrated environmental management strategy provides sufficient forced air for contaminate control and cooling to match power consumption of the reproduction apparatus, capture substantially all acoustic energy within the reproduction apparatus and dissipate it there through the process of absorption, provide cooling air inlet and exhaust passages which do not compromise the acoustic performance of the reproduction apparatus, and use a catalytic ozone reduction filter in a common air exhaust passage. All of the above is accomplished without increasing the total space required for the reproduction apparatus (that is, the foot print of the apparatus at the user cite), while accommodating for any additional environmental impact resulting from optional accessories added to the reproduction apparatus.

Figure 2:
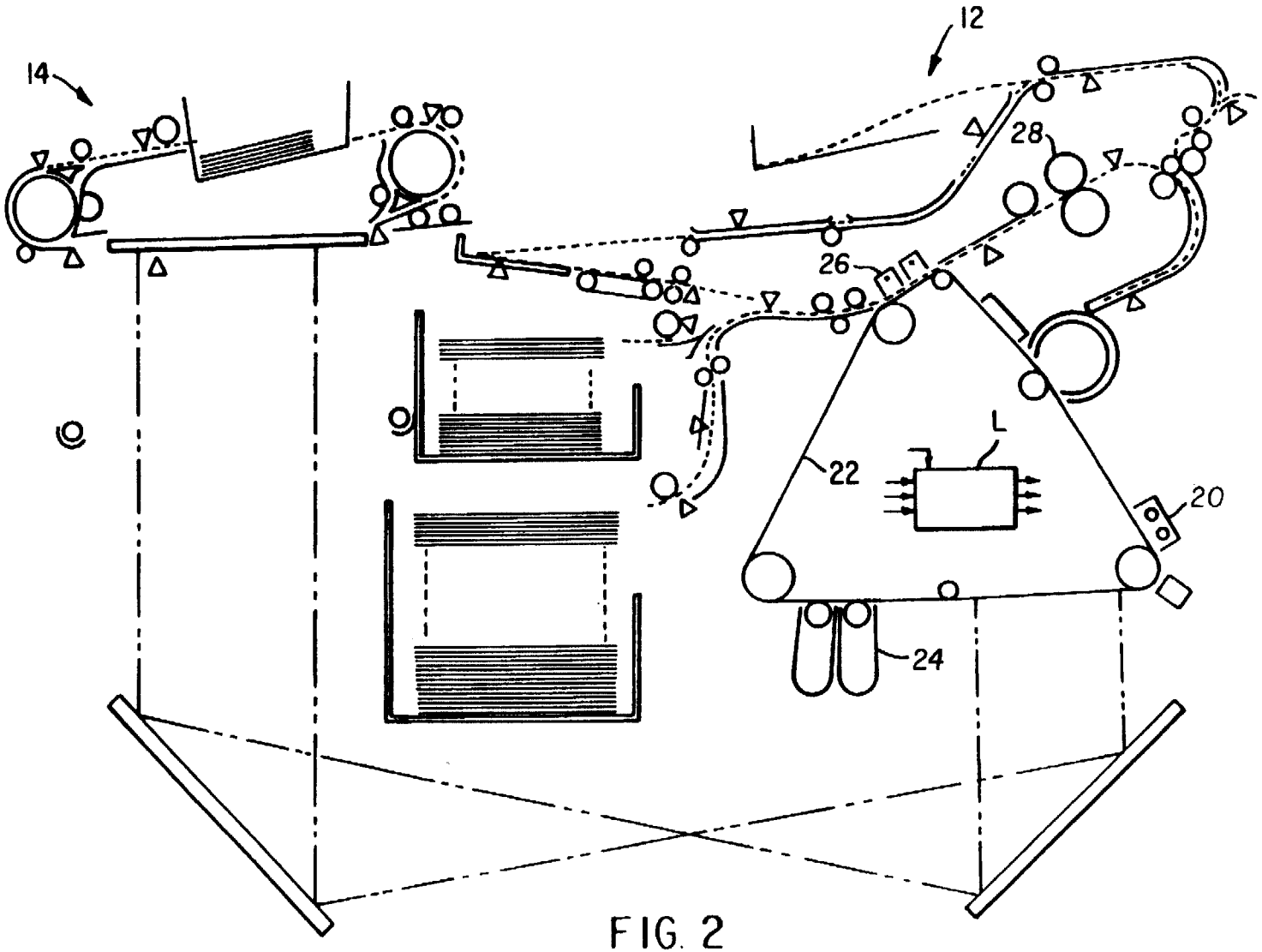
FIG. 2 is a schematic illustration of the interior of the exemplary reproduction apparatus and the electrographic process stations associated therewith.

FIG. 2 shows the interior of the reproduction apparatus 10, the electrographic process stations associated therewith, and the microprocessor based logic and control unit L for controlling operation of the reproduction apparatus. Under the control of the logic and control unit L, a latent image charge pattern is formed on a moving charge-retentive or photo-conductive member having dielectric characteristics (hereinafter referred to as the dielectric support 22), after the dielectric support has been uniformly charged by a corona charger 20. Pigmented marking particles from a development station 24 are attracted to the latent image charge pattern to develop such image on the dielectric support 22. A receiver member, such as a sheet of paper, transparency or other medium, is then brought into contact with the dielectric support, and an electric field is applied by a charger 26 to transfer the marking particle developed image to the receiver member from the dielectric support. After transfer, the receiver member bearing the transferred image is transported away from the dielectric support, and the image is fixed (fused) to the receiver member, in a fusing station 28, by heat and pressure to form a permanent reproduction thereon.

Figure 3:
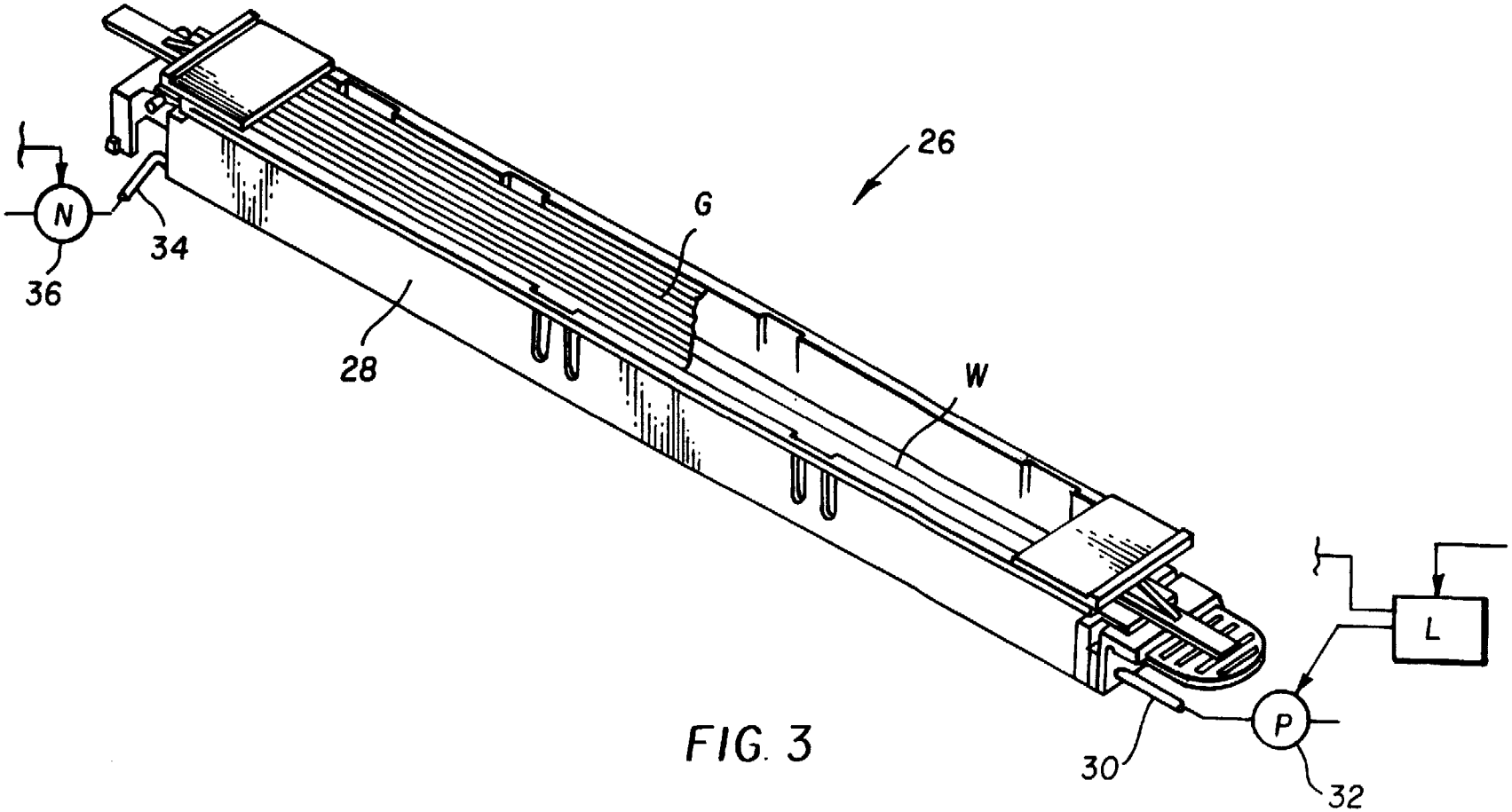
FIG. 3 is a view, in perspective, of the charger and the air flow directing device for the charger environmental control according to this invention.

A typical corona charger, such as the charger 26, and the environmental control for removing stagnant air and generated ozone and oxides of nitrogen from around the charger is shown in FIG. 3. Of course, the environmental control for removing stagnant air and generated ozone and oxides of nitrogen from around the charger can be used with any of the other chargers present in the electrographic process, or any other corona type chargers which could be used in such process. As discussed above, the removal of ozone and oxides of nitrogen are necessary since otherwise corona contaminates can combine with water vapor in the ambient air to produce acids which can collect on the charger components and associated hardware.

The charger 26 has a housing 28 which is substantially U-shaped in cross-section. A grid G may be provided to span the opening between the legs of the housing. A corona wire W runs through the housing 28 and is electrically coupled in any well known manner (not shown) to a suitable electrical potential source. According to this invention, air flow is directed to the housing 28 of the charger 26 at one end thereof by a conduit 30, in flow communication at one end with the interior of the housing. The opposite end of the conduit 30 is connected to a positive pressure air source 32, under the control of the logic and control unit L. The opposite end of the housing 28 has a conduit 34 in flow communication, at one end, with the interior of the housing. The opposite end of the conduit 34 is connected to a negative pressure air source 36, similarly under the control of the logic and control unit L. Of course, alternatively, the interior of the housing of the charger could be in flow communication with the air source with any other suitable connections; and the air source could be selectively reversible to produce positive or negative pressure air flow.

During operation of the reproduction apparatus 10, when the dielectric support 22 is in motion with respect to the charger 26, the environment within the charger is controlled to be at a positive pressure. Filtered air, from which particulates and fibers have been removed, under the selective control of the logic and control unit L, is caused to flow through the charger housing 28 from the air source 32, via the conduit 30. The outward flow of pressurized air from the charger housing carries the generated ozone and oxides of nitrogen into the return air flow of the reproduction apparatus environmental control system for neutralization and removal thereby. Due to the relative motion between the dielectric support 22 and the charger 26, conductive chemical species deposited on the dielectric support will be at a negligible concentration. Therefore, blurring of the latent electrostatic image on the dielectric support is substantially prevented. Of course, the filtered air input could be heated and/or dried to enhance suppression of image blurring on the dielectric support.

Moreover, any possible oxidative degradation of the dielectric support 22 by chemically reactive ozone is also minimized. This is due to the fact that the impingement rate and absorption rate of ozone, and the subsequent desorption after leaving the vicinity of the charger, keeps the surface concentration of ozone on the dielectric support low enough to substantially prevent chemical damage. Furthermore, by operating the charger in a positive pressure environment, with respect to the remainder of the reproduction apparatus, contamination of the charger by particulates and fibers is also substantially prevented in that the particles and fibers are delivered into the return air flow of the reproduction apparatus environmental control system for neutralization and removal.

At a time when the charger 26 is stationary with respect to the dielectric support 22 for any significant period of time (e.g., stand-by or cycle-down), the relative pressure within the charger is reversed. That is, instead of the pressure within the housing 28 of the charger 26 being positive, it is caused to be negative. The air flow from the source 36, under the selective control of the logic and control unit L, causes the negative pressure to be drawn through the conduit 34. The negative air flow carries oxides of nitrogen, desorbing from the walls, wire W or grid G of the charger, away from the dielectric support 22 into the return air flow of the reproduction apparatus environmental control system for neutralization and removal thereby. The chemical products produced from the oxides of nitrogen, as well as other corona-generated species, are similarly removed in the negative air flow. As such the conductivity inducing contaminates are caused to flow away from the dielectric support surface when the dielectric support is parked for an extended period of time.

There should be a time interval after the dielectric support comes to rest (i.e., is parked) before the relative pressure within the charger is changed from positive to negative. During this time interval, airborne particles and fibers, generated by operation of the reproduction apparatus in the active mode, have time to settle out in areas remote from the charger environment. It may be desirable, after the dielectric support stops, to gradually reduce the relative positive pressure to zero, and then gradually make the relative pressure negative so as to avoid contamination of the charger by the airborne particles and fibers generated during operation. On the other hand, when the reproduction apparatus is put into the cycle-up mode, positive air pressure should be rapidly re-established inside the charger environment in order to avoid contamination by particles and fibers which become airborne on such start up.

The invention has been described in detail with particular reference to the preferred embodiment thereof, but it will be understood that variations and modifications can be effected within the spirit and scope of the invention as set forth in the claims.

What is claimed is:

1. An environmental control for a charger utilized in an electrostatographic reproduction apparatus including a movable dielectric support upon which images of information to be reproduced are formed as said dielectric support is moved into operative relation with electrostatic process stations, said charger environmental control system comprising:

a housing associated with charger;

means for providing a positive pressure air flow to said housing;

means for providing a negative pressure air flow to said housing; and means for selectively controlling said positive pressure air flow means and said negative pressure air flow means such that during movement of the dielectric support of a reproduction apparatus, positive pressure air flow is provided to said charger housing, and when such dielectric support is at rest, negative pressure air flow is provided to said charger housing.

2. The charger environmental control according to claim 1 wherein said positive pressure air flow means includes a source of positive pressure air flow and a conduit in flow communication with said positive pressure air flow source and the interior of said charger housing, and said negative pressure air flow means includes a source of negative pressure air flow and a conduit in flow communication with said negative pressure air flow source and the interior of said charger housing.

3. The charger environmental control according to claim 1 wherein said positive pressure air flow means and said negative pressure air flow means include a source of air flow capable of being reversed so as to selectively provide positive pressure air flow means and said negative pressure air flow means, and a conduit in flow communication to said air flow source and the interior of said charger housing.

4. The charger environmental control according to claim 1 wherein said selective control means provides for a time interval after the dielectric support comes to rest before air pressure within said charger housing is changed from positive to negative.

5. The charger environmental control according to claim 4 wherein, after the dielectric support comes to rest, said selective control means provides for gradually reducing positive air pressure to zero, and thereafter gradually making air pressure negative.

6. The charger environmental control according to claim 4 wherein, after the dielectric support comes to rest, said selective control means provides for gradually reducing positive air pressure to zero, and thereafter gradually making air pressure negative, and when the dielectric support is put into motion, said selective control means provides for positive air pressure to be rapidly re-established within said charger housing.

7. The charger environmental control according to claim 1 wherein, when the dielectric support is put into motion, said selective control means provides for positive air pressure to be rapidly re-established inside said charger housing.

8. An environmental control for a charger utilized in an electrostatographic reproduction apparatus including a movable dielectric support upon which images of information to be reproduced are formed as said dielectric support is moved into operative relation with electrostatic process stations, a method for controlling the environment of a charger utilized by said reproduction apparatus, said charger environment control comprising the steps of:

selectively providing a positive pressure air flow to the charger environment during movement of the dielectric support of the reproduction apparatus; and selectively providing a negative pressure air flow to the charger environment when such dielectric support is at rest.

9. The charger environmental control method according to claim 8 wherein after the dielectric support comes to rest, gradually reducing the positive air pressure to zero, and then gradually making the air pressure negative.

10. The charger environmental control method according to claim 8 wherein when the dielectric support is put into motion, positive air pressure is rapidly re-established within the charger housing.

11. The charger environmental control method according to claim 8 wherein after the dielectric support comes to rest, gradually reducing the positive air pressure to zero, and then gradually making the air pressure negative, and when the dielectric support is put into motion, positive air pressure is rapidly re-established within the charger housing.

* * * * *